US010744790B2

(12) United States Patent
Minami et al.

(10) Patent No.: US 10,744,790 B2
(45) Date of Patent: Aug. 18, 2020

(54) PRINTING DEVICE PROVIDED WITH THERMAL HEAD HAVING A PLURALITY OF HEATING ELEMENTS ARRANGED THEREIN

(71) Applicant: BROTHER KOGYO KABUSHIKI KAISHA, Nagoya-shi (JP)

(72) Inventors: Akira Minami, Nagoya (JP); Tomohiro Kondo, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/393,903

(22) Filed: Apr. 24, 2019

(65) Prior Publication Data

US 2019/0351681 A1 Nov. 21, 2019

(30) Foreign Application Priority Data

May 18, 2018 (JP) ..... 2018-096671

(51) Int. Cl.
*B41J 2/355* (2006.01)
*B41J 3/407* (2006.01)
*B41J 29/38* (2006.01)

(52) U.S. Cl.
CPC ..... *B41J 2/3558* (2013.01); *B41J 3/4075* (2013.01); *B41J 29/38* (2013.01)

(58) Field of Classification Search
CPC ..... B41J 2/3558; B41J 3/4075; B41J 29/38
See application file for complete search history.

(56) References Cited

U.S. PATENT DOCUMENTS 6,002,429 A * 12/1999 Ochi ..... H04N 1/00127 348/220.1
10,207,517 B1 * 2/2019 Arakane ..... B41J 2/2135

FOREIGN PATENT DOCUMENTS

JP 5379833 B2 12/2013

* cited by examiner

*Primary Examiner* — Lamson D Nguyen
(74) *Attorney, Agent, or Firm* — Kenealy Vaidya LLP

(57) ABSTRACT

In a printing device, a thermal head has heating elements and prints an image made up of line images. A memory stores sets of parameters, each set including one of first parameters and corresponding one of second parameters. The controller calculates an average consumed power with respect to a line image subject to calculation by dividing a total amount of consumed power by a period of time set in each first parameter, thereby providing average consumed powers for the sets of parameters. The total amount of consumed power is an accumulated consumed power consumed in the heating elements energized during printing in the period of time including a print timing of the line image subject to calculation. The controller sets a cycle time for printing the line image subject to calculation so that each average consumed power does not exceed an upper limit specified by corresponding one of second parameters.

13 Claims, 13 Drawing Sheets

FIG. 5

| PARAMETER SET S | LIMITING PERIOD OF TIME t | AVERAGE POWER UPPER LIMIT Wlim | FIRST SET CYCLE POWER Wmax | SECOND SET CYCLE POWER Wmin |
|---|---|---|---|---|
| S1 | t1 (=10ms) | Wlim1 (=600W) | Wmax (=650W) (=Wlim1+Z1) (=Wlim2+Z2) (=Wlim3+Z3) | Wmin1 (=550W) (=Wlim1−Y1) |
| S2 | t2 (=100ms) | Wlim2 (=400W) | | Wmin2 (=350W) (=Wlim2−Y2) |
| S3 | t3 (=10s) | Wlim3 (=60W) | | Wmin3 (=40W) (=Wlim3−Y3) |

FIG. 11

| PRINTING SPEED | SET DENSITY [μsec] | | | | |
|---|---|---|---|---|---|
| mm/sec | SET DENSITY 1 | SET DENSITY 2 | SET DENSITY 3 | SET DENSITY 4 | SET DENSITY 5 |
| 80 | 365 | 401 | 441 | 485 | 533 |
| 60 | 500 | 550 | 605 | 665 | 731 |
| 50 | 600 | 660 | 726 | 798 | 877 |
| 40 | 700 | 770 | 847 | 931 | 1024 |
| 20 | 800 | 880 | 968 | 1064 | 1170 |

FIG. 12

| PARAMETER SET | DIFFERENCE VALUE M BETWEEN AVERAGE POWER UPPER LIMIT Wlim AND AVERAGE POWER Wave | CYCLE POWER LIMIT Wx |
|---|---|---|
| S1 | M1≥550W | Wx1 (=650W) |
| | 550W>M1≥500W | Wx1 (=638W) |
| | 500W>M1≥450W | Wx1 (=626W) |
| | 450W>M1≥350W | Wx1 (=614W) |
| | 350W>M1≥300W | Wx1 (=602W) |
| | 300W>M1≥250W | Wx1 (=590W) |
| | 250W>M1≥200W | Wx1 (=578W) |
| | 200W>M1≥150W | Wx1 (=566W) |
| | 150W>M1≥100W | Wx1 (=554W) |
| | 100W>M1 | Wx1 (=550W) |
| S2 | M2≥350W | Wx2 (=650W) |
| | 350W>M2≥300W | Wx2 (=450W) |
| | 300W>M2 | Wx2 (=350W) |
| S3 | M3≥59W | Wx3 (=650W) |
| | 59W>M3≥58W | Wx3 (=446W) |
| | 58W>M3≥57W | Wx3 (=242W) |
| | 57W>M3 | Wx3 (=40W) |

FIG. 13

| PARAMETER SET | AVERAGE POWER Wave | CYCLE POWER LIMIT Wx |
|---|---|---|
| S1 | Wave1≤50W | Wx1 (=650W) |
| | 50W<Wave1≤100W | Wx1 (=638W) |
| | 100W<Wave1≤150W | Wx1 (=626W) |
| | 150W<Wave1≤250W | Wx1 (=614W) |
| | 250W<Wave1≤300W | Wx1 (=602W) |
| | 300W<Wave1≤350W | Wx1 (=590W) |
| | 350W<Wave1≤400W | Wx1 (=578W) |
| | 400W<Wave1≤450W | Wx1 (=566W) |
| | 450W<Wave1≤500W | Wx1 (=554W) |
| | 500W<Wave1 | Wx1 (=550W) |
| S2 | Wave2≤50W | Wx2 (=650W) |
| | 50W<Wave2≤100W | Wx2 (=450W) |
| | 100W<Wave2 | Wx2 (=350W) |
| S3 | Wave3≤1W | Wx3 (=650W) |
| | 1W<Wave3≤2W | Wx3 (=446W) |
| | 2W<Wave3≤3W | Wx3 (=242W) |
| | 3W<Wave3 | Wx3 (=40W) |

PRINTING DEVICE PROVIDED WITH THERMAL HEAD HAVING A PLURALITY OF HEATING ELEMENTS ARRANGED THEREIN

CROSS REFERENCE TO RELATED APPLICATION

This application claims priority from Japanese Patent Application No. 2018-096671 filed May 18, 2018. The entire content of the priority application is incorporated herein by reference.

TECHNICAL FIELD

The present disclosure relates to a printing device and a non-transitory computer-readable storage medium storing a set of program instructions for the printing device.

BACKGROUND

A thermal printer capable of variably controlling the printing speed is well known in the art, such as a thermal printer provided with a thermal head, a detection unit, a control unit, and the like. The thermal head has a plurality of heating elements arranged therein. The thermal head prints on a recording medium using heat generated from the heating elements. The thermal head generates heat through power supplied via an RLC circuit from a rechargeable battery or power supply. The detection unit detects the voltage supplied to the heating elements. The control unit controls the printing speed variably depending on the surplus power at the average current value (i.e., the average value of current supplied to the heating elements), and the average print coverage prior to the line to be printed.

SUMMARY

However, the variable control performed by the control unit of the conventional thermal printer cannot always account for a plurality of limitations, such as the power limitations of the rechargeable battery or power supply and limitations in heat capacity. In such cases, the thermal printer cannot efficiently control the printing speed and may take a long time to complete printing.

In view of the foregoing, it is an object of the present disclosure to provide a printing device and a non-transitory computer-readable storage medium storing a set of program instructions for the printing device capable of reducing the time required to complete printing by increasing the printing speed while accounting for a plurality of limitations.

In order to attain the above and other objects, the present disclosure provides a printing device including: a thermal head; a memory; and a controller. The thermal head is configured to print an image on a printing medium. The thermal head has a plurality of heating elements. The plurality of heating elements is aligned in a main scanning direction and is configured to be selectively energized to generate heat in accordance with print data. The image is made up of a plurality of line images arranged in a sub scanning direction orthogonal to the main scanning direction. Printing of each of the plurality of line images is accomplished during a cycle time. The cycle time includes an energizing period of time, a feeding period of time, and an extra period of time. During the energizing period of time, selected heating elements for printing one of the plurality of line images are energized. During the feeding period of time, the printing medium is fed in the sub scanning direction after energization of selected the heating elements. The memory is configured to store a plurality of sets of parameters. Each set of parameters includes one of a plurality of first parameters and corresponding one of a plurality of second parameters. The plurality of first parameters specify periods of time. The plurality of second parameters specify upper limits of an average power during the period of time set in corresponding one of the plurality of first parameters. The controller is configured to perform: calculating an average consumed power with respect to a line image subject to calculation, the average consumed power being calculated by dividing a total amount of consumed power by the period of time set in each of the plurality first parameters, thereby providing a plurality of average consumed powers for respective ones of the plurality of sets of parameters, the total amount of consumed power being an accumulated consumed power consumed in the heating elements energized during printing of a predetermined number of line images in the period of time including a print timing of the line image subject to calculation, printing of the line image subject to calculation starting at the print timing; setting the cycle time for printing the line image subject to calculation, the cycle time being set so that each of the plurality of average consumed powers does not exceed the upper limit of the each of the plurality of average consumed powers specified by corresponding one of the plurality of second parameters; and printing the line image subject to calculation in accordance with the cycle time.

According to another aspect, the present disclosure provides a non-transitory computer readable storage medium storing a set of program instructions for a printing device. The printing device includes: a thermal head; a memory; and a controller. The thermal head is configured to print an image on a printing medium. The thermal head has a plurality of heating elements. The plurality of heating elements is aligned in a main scanning direction and is configured to be selectively energized to generate heat in accordance with print data. The image is made up of a plurality of line images arranged in a sub scanning direction orthogonal to the main scanning direction. Printing of each of the plurality of line images is accomplished during a cycle time. The cycle time includes an energizing period of time, a feeding period of time, and an extra period of time. During the energizing period of time, selected heating elements for printing one of the plurality of line images are energized. During the feeding period of time, the printing medium is fed in the sub scanning direction after energization of the selected heating elements. The memory is configured to store a plurality of sets of parameters. Each set of parameters includes one of a plurality of first parameters and corresponding one of a plurality of second parameters. The plurality of first parameters specify periods of time. The plurality of second parameters specify upper limits of an average power during the period of time set in corresponding one of the plurality of first parameters. The set of program instructions, when installed on and executed by the controller, causes the printing device to perform: calculating an average consumed power with respect to a line image subject to calculation, the average consumed power being calculated by dividing a total amount of consumed power by the period of time set in each of the plurality first parameters, thereby providing a plurality of average consumed powers for respective ones of the plurality of sets of parameters, the total amount of consumed power being an accumulated consumed power consumed in the heating elements energized during printing of a predetermined number of line images in the period of time including a print timing of the line image subject to calculation, printing of the line image subject to calculation starting at the print timing; setting the cycle time for printing the line image subject to calculation, the cycle time being set so that each of the plurality of average consumed powers do does not exceed the upper limit of the average power specified by corresponding one of the plurality of second parameters; and printing the line image subject to calculation in accordance with the cycle time.

According to still another aspect, the present disclosure provides A printing device including: a thermal head; a memory; and a controller. The thermal head is configured to print an image on a printing medium. The thermal head has a plurality of heating elements aligned in a main scanning direction and is configured to be selectively energized to generate heat in accordance with print data. The image is mead up of a plurality of line images arranged in a sub scanning direction orthogonal to the main scanning direction. Printing of each of the plurality of line images is accomplished during a cycle time. The cycle time includes an energizing period of time, a feeding period of time, and an extra period of time. During the energizing period of time, selected heating elements for printing one of the plurality of line images are energized. During the feeding period of time, the printing medium is fed in the sub scanning direction after energization of selected the heating elements. The memory is configured to store a plurality of sets of parameters. Each set of parameters includes one of a plurality of first parameters and corresponding one of a plurality of second parameters. The plurality of first parameters specifies periods of time. The plurality of second parameters specifies upper limits of power during the period of time set in corresponding one of the plurality of first parameters. The controller is configured to perform: determining a consumed power with respect to a line image subject to determination, thereby providing a plurality of consumed powers for respective ones of the plurality of sets of parameters, the total amount of consumed power being an accumulated consumed power consumed in the heating elements energized during printing of a predetermined number of line images in the period of time including a print timing of the ling image subject to determination, printing of the line image subject to determination starting at the print timing; setting the cycle time for printing the line image subject to determination, the cycle time being set so that each of the plurality of consumed powers does not exceed the upper limit of the power specified by corresponding one of the plurality of second parameters; and printing the line image subject to determination in accordance with the cycle time.

BRIEF DESCRIPTION OF THE DRAWINGS

The particular features and advantages of the disclosure as well as other objects will become apparent from the following description taken in connection with the accompanying drawings, in which:

FIG. 5 illustrates a table showing an example of specific values for each parameter set in which a limiting period of time, an average power upper limit, first set cycle power, and second set cycle power are included;

FIG. 11 illustrates a table showing an example of relationships between printing speeds and set densities used in a printing device according to a variation of the embodiment;

FIG. 12 illustrates a table showing another example of specific values for each parameter set in which a deference value between an average power upper limit and average power and a cycle power limit are included; and FIG. 13 illustrates a table showing still another example of specific values for each parameter set in which average power and a cycle power limit are included.

DETAILED DESCRIPTION

Figure 1:
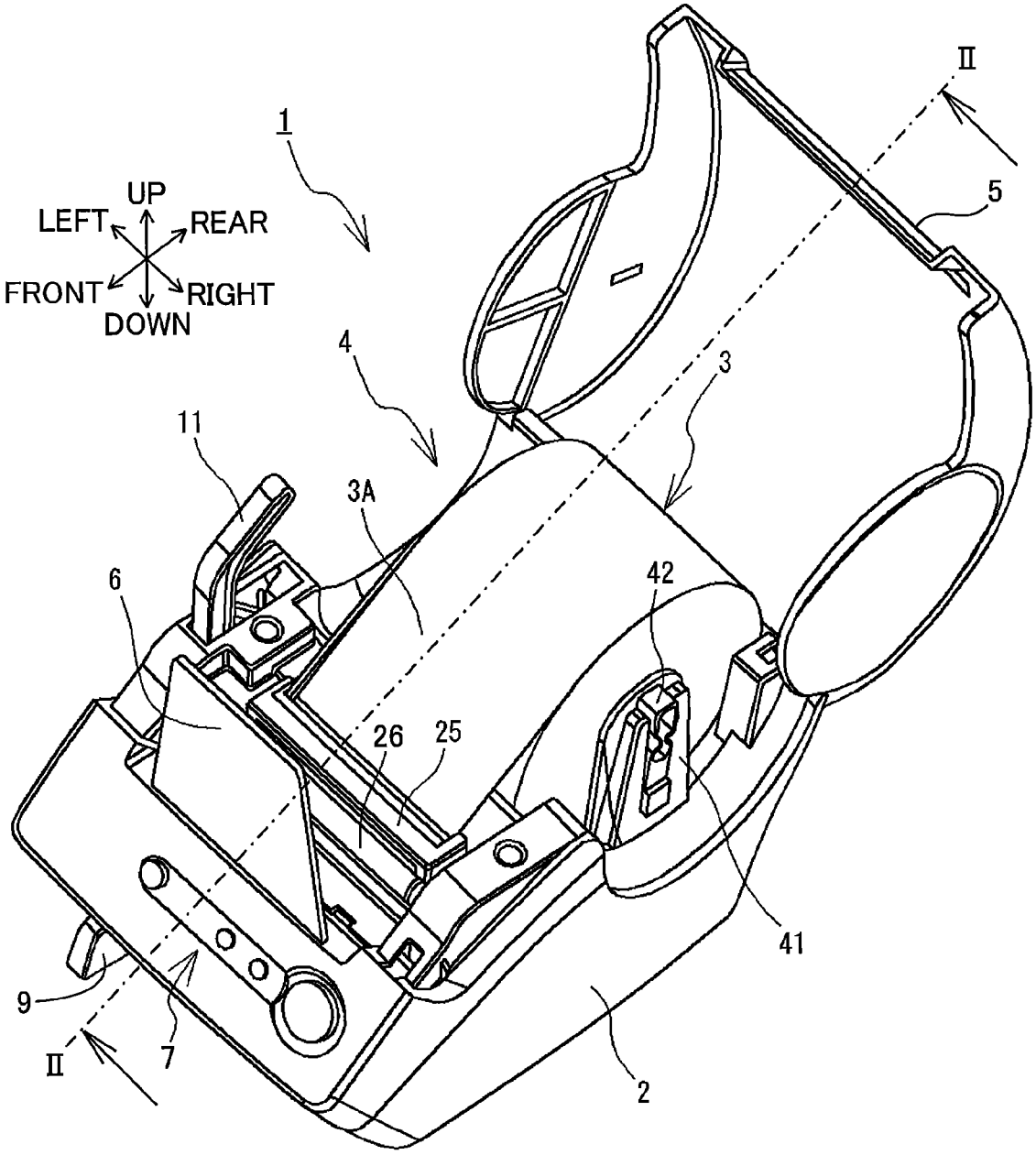
FIG. 1 is a perspective view of a printing device with a cover open according to a first embodiment of the present disclosure.

Next, embodiments of the present disclosure will be described while referring to the accompanying drawings. The referenced drawings are used to describe the technical features that the present disclosure can employ. The device configurations, flowcharts for the various processes, and the like depicted in the drawings are merely examples, and the present disclosure is not intended to be limited to these configurations, flowcharts, and the like. In the following description, the lower-right, upper-left, upper-right, lower-left, top, and bottom sides of a printing device 1 in FIG. 1 are respectively defined as the right, left, rear, front, top, and bottom sides of the printing device 1, as indicated by arrows in FIG. 1.

First Embodiment

<Overview of a Printing Device 1>

Figure 2:
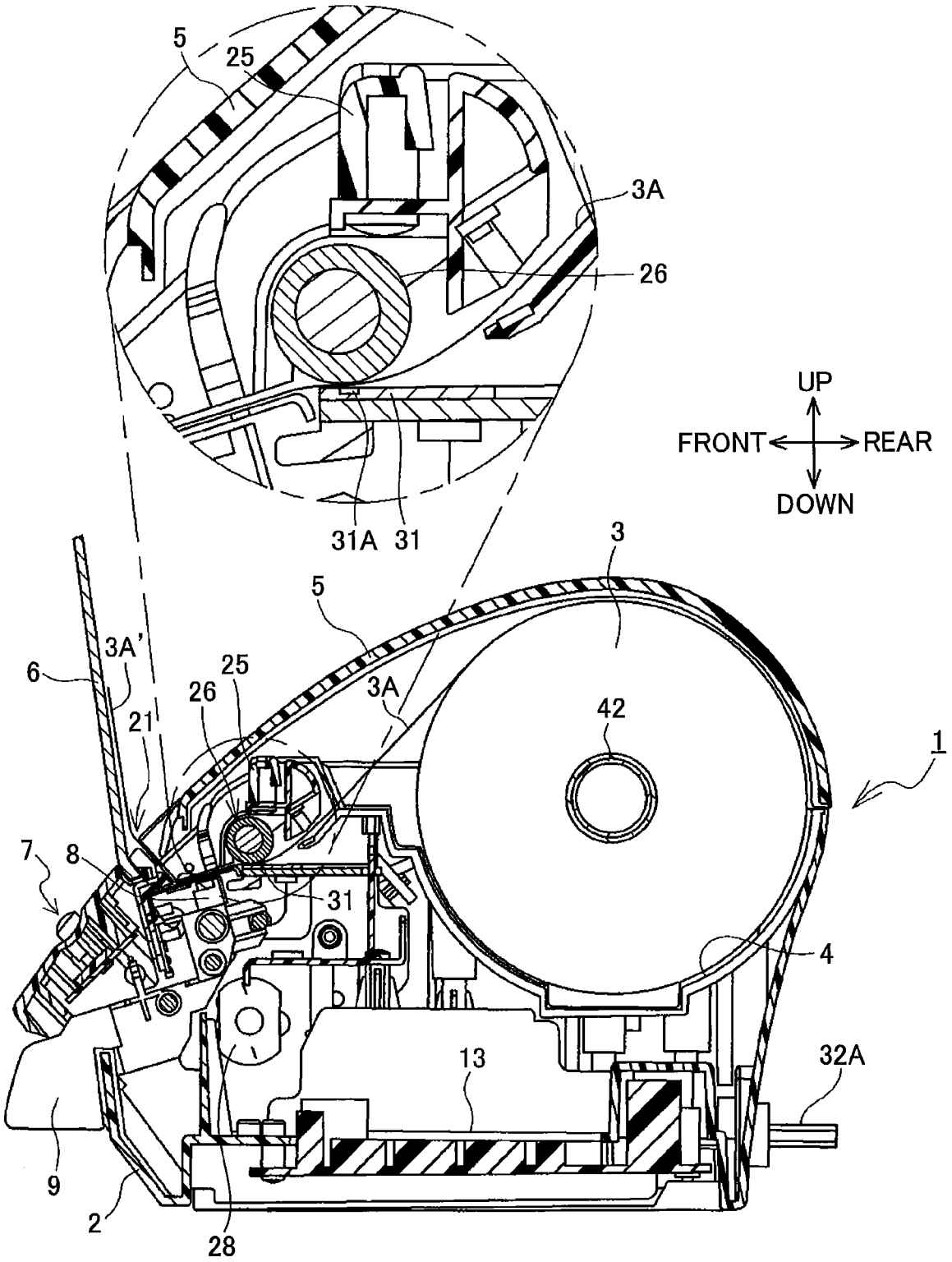
FIG. 2 is a cross-sectional view of the printing device with the cover closed taken along a line II-II illustrated in FIG. 1.

FIGS. 1 and 2 illustrate a printing device 1 according to a first embodiment. In the present embodiment, the printing device 1 is a thermal printer. The printing device 1 performs printing operations by heating a printing sheet 3A with a thermal head 31 (see FIG. 6) to produce color in units of dots on the printing sheet 3A. The printing sheet 3A comprises a heat-sensitive color-forming layer formed on a base material. As will be described later, the printing sheet 3A is rolled into a sheet roll 3 that is accommodated in a housing 2 of the printing device 1, and the printing sheet 3A is pulled off the sheet roll 3 when the printing device 1 prints on the printing sheet 3A.

FIG. 1 is a perspective view of the printing device 1 with a cover 5 open, and FIG. 2 is a cross-sectional view of the printing device 1 taken along a line II-II illustrated in FIG. 1. The printing device 1 has an outer casing configured of a housing 2, and the cover 5. The housing 2 has a box-like shape with an opening in the top. The housing 2 is generally rectangular in front and plan views and is elongated in the front-rear direction. The cover 5 covers the open area in the top of the housing 2. The cover 5 is pivotably supported on the rear side of the opening formed in the housing 2 by a pivotal shaft oriented in the left-right direction. The housing 2 is opened (FIG. 1) and closed (FIG. 2) by pivoting the cover 5 about the pivotal shaft so that the front end of the cover 5 moves up and down.

A sheet roll accommodating compartment 4 is provided in the rear portion of the housing 2. The sheet roll accommodating compartment 4 is exposed through the opening in the top of the housing 2 when the cover 5 is pivoted open. The sheet roll accommodating compartment 4 accommodates a sheet roll 3.

More specifically, the housing 2 is provided with two support parts 41 arranged in an upright state on respective left and right sides of the sheet roll accommodating compartment 4. The sheet roll 3 is formed of a printing sheet 3A that has been wound about a tape spool 42 so that the surface to be printed faces inward. The tape spool 42 is provided with a shaft part that is oriented in the left-right direction. The left and right ends of the shaft part engage with the left and right support parts 41 and are rotatably supported by the same. Thus, the sheet roll 3 is rotatably supported on the tape spool 42 in the sheet roll accommodating compartment 4.

On the front side of the sheet roll accommodating compartment 4, the printing device 1 is further provided with a roller holder 25, a platen roller 26, and a thermal head 31. The roller holder 25 extends along the left-right direction. The roller holder 25 holds the platen roller 26 so that the platen roller 26 is rotatable about an axis aligned in the left-right direction.

The thermal head 31 is provided with a plurality of heating elements 31A arranged therein. The heating elements 31A are aligned in a row along the left-right direction. The thermal head 31 prints on the printing sheet 3A using heat generated from the heating elements 31A. The platen roller 26 is disposed above the thermal head 31 and confronts the plurality of heating elements 31A in the thermal head 31. The printing sheet 3A pulled off the sheet roll 3 is inserted between the platen roller 26 and the thermal head 31. A conveying motor 28 drives the platen roller 26 to rotate during a printing operation for conveying the printing sheet 3A.

A lever 11 is provided on the front-left side of the sheet roll accommodating compartment 4. The lever 11 is positioned to the left of the roller holder 25 and is coupled to the same. The roller holder 25 moves up and down about support points on its rear edge in association with the up and down rotation of the lever 11. The lever 11 is constantly urged upward by a coil spring (not illustrated).

When the cover 5 is closed, the lever 11 is pressed downward by the cover 5. When the lever 11 rotates downward, the roller holder 25 moves downward, and the platen roller 26 held in the roller holder 25 presses the printing sheet 3A against the thermal head 31. In this condition, the printing device 1 is in a printing enabled state. When the cover 5 is opened, the lever 11 rotates upward, moving the roller holder 25 upward, and the platen roller 26 held in the roller holder 25 separates from the thermal head 31 and the printing sheet 3A. In this condition, the printing device 1 is in a printing disabled state.

When the cover 5 is closed, a discharge opening 21 is formed on the front side of the roller holder 25 between the front edge of the cover 5 and the housing 2. The discharge opening 21 is elongated in the left-right direction. The printing sheet 3A printed by the thermal head 31 is conveyed out through the discharge opening by the platen roller 26.

A plate-shaped tray 6 formed of a transparent resin is erected from the housing 2 on the front side of the discharge opening 21. The tray 6 receives the printed printing sheet 3A' discharged from the discharge opening 21, as illustrated in FIG. 2.

A cutting lever 9 is provided on the front surface of the housing 2. The cutting lever 9 can move in the left and right directions. The cutting lever 9 is coupled to a cutting unit 8. When the cutting lever 9 is moved in the left and right directions after the print sheet 3A has been printed, the cutting unit 8 moves left and right, cutting off the printed printing sheet 3A' from the sheet roll 3.

Input keys 7 are provided on the top surface of the housing 2 near the front end thereof at a position on the front side of the tray 6. The input keys 7 include a power switch. The input keys 7 receive input through user operations. A circuit board 13 is disposed below the sheet roll accommodating compartment 4. The circuit board 13 includes a CPU 52 (see FIG. 3) that controls an entirety of the printing device 1.

A connector (not illustrated) is provided in the rear surface of the housing 2 near the bottom thereof. The connector allows an external terminal or the like to be connected to the printing device 1 with a USB cable (not illustrated). Also provided in the rear surface of the housing 2 near the bottom thereof is a connector for connecting power cable 32A of an AC adapter 32 (see FIG. 3) that supplies power to the printing device 1.

The printing device 1 receives print data from the external terminal through the USB cable. The external terminal may be a common person computer (PC), a portable terminal, or a tablet computer, for example. A CPU (not illustrated) in the external terminal executes a device driver program (not illustrated) installed on the terminal to generate print data from image data. The print data is formed by breaking down the image data into data for a plurality of corresponding dots.

During printing operation on the printing device 1 having the above construction, the roller holder 25 urges the platen roller 26 toward the thermal head 31. The conveying motor 28, which is a pulse motor, drives the platen roller 26 to rotate. By rotating, the platen roller 26 conveys the printing sheet 3A interposed between the thermal head 31 and platen roller 26. The printing device 1 prints on the printing sheet 3A using the thermal head 31 as the printing sheet 3A is conveyed from the sheet roller accommodating compartment 4 toward the discharge opening 21. The printing device 1 can print a print image G configured of characters, graphical images, and the like (see the example in FIG. 4A).

<Electrical Structure of the Printing Device 1>

Figure 3:
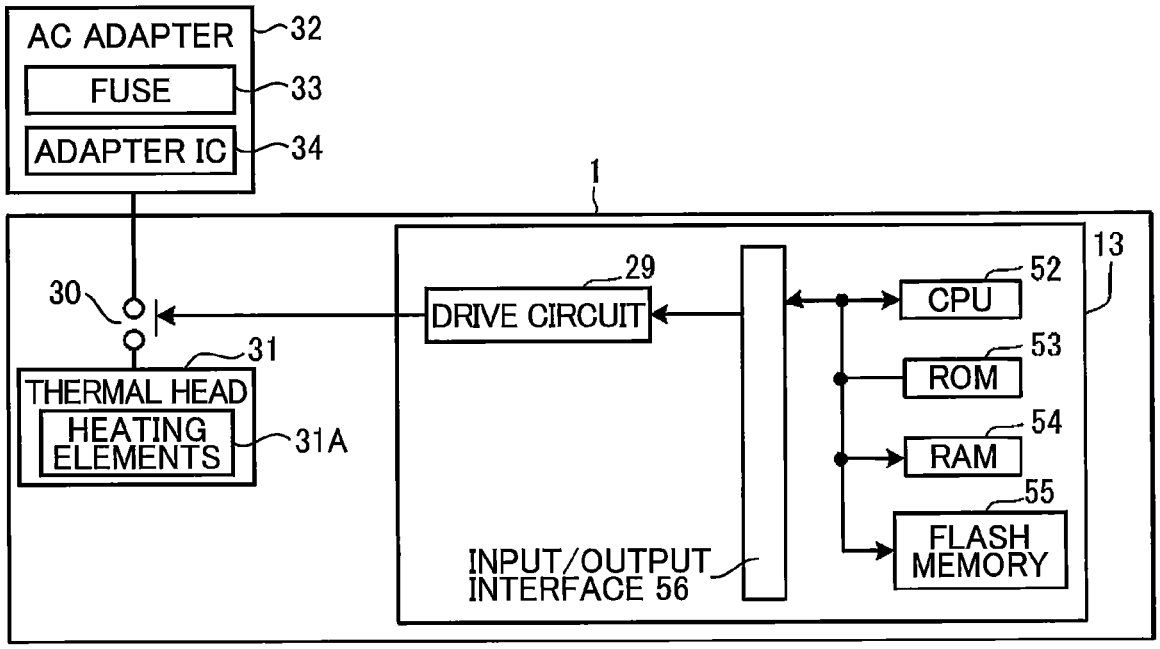
FIG. 3 is a block diagram illustrating an electrical structure of the printing device according to the first embodiment.

As illustrated in FIG. 3, the printing device 1 has the circuit board 13, and the thermal head 31 as its primary components. The circuit board 13 is provided with the CPU 52 that controls the operations of the printing device 1. The CPU 52 is connected to a ROM 53, a RAM 54, a flash memory 55, and a drive circuit 29 via an input/output interface 56.

The ROM 53 stores a program executed by the CPU 52. The RAM 54 stores various temporary data. The flash memory 55 stores print data received from an external terminal and parameter sets S1 to S3 (see FIG. 5) described later. The drive circuit 29 controls the ON/OFF setting of a switch 30 provided between the AC adapter 32 and thermal head 31. Through ON/OFF control of the switch 30, the drive circuit 29 controls whether electricity is supplied to the plurality of heating elements 31A provided in the thermal head 31. The period of time during which the drive circuit 29 sets the switch 30 to ON corresponds to a heating time Ton described later, while the period during which the drive circuit 29 sets the switch to OFF corresponds to an idle time Toff described later.

The thermal head 31 is provided with the heating elements 31A aligned in the left-right direction corresponding to the width direction of the printing sheet 3A (hereinafter also called the "main scanning direction"). The thermal head 31 forms the print image G on the printing sheet 3A by heating the heating elements 31A while the printing sheet 3A is moved relative to the thermal head 31 in the front direction (hereinafter also called the "sub scanning direction" and the "conveying direction") orthogonal to the main scanning direction.

The AC adapter 32 converts AC power to DC power and supplies this DC power to the printing device 1. The AC adapter 32 is provided with an adapter IC 34 and a fuse 33. The fuse 33 is interposed between the AC power supply and the thermal head 31 of the printing device 1. The fuse 33 prevents excess current from flowing to the thermal head 31 by interrupting the supply of current from the AC adapter 32 to the thermal head 31 when a prescribed power is supplied for a prescribed time.

<Overview of Printing Control>

Figure 4A:
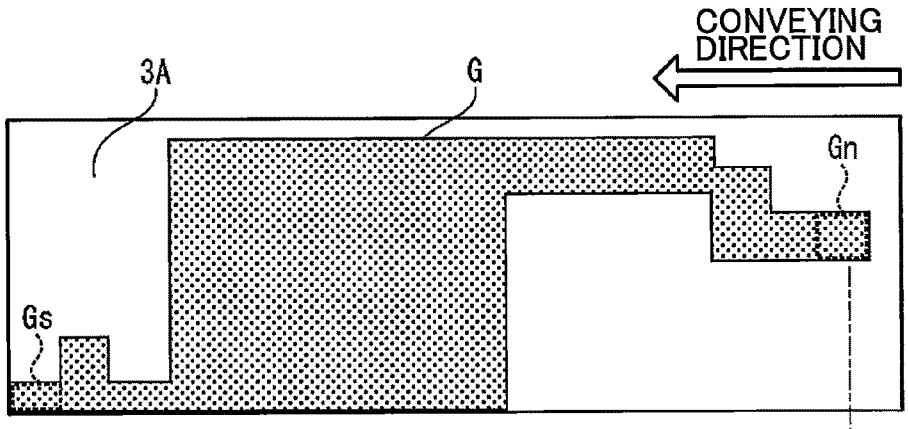
FIG. 4A illustrates an example of a print image formed through printing operations by the printing device according to the first embodiment.

FIG. 4A illustrates an example of the print image G formed through printing operations by the printing device 1. By selectively energizing the heating elements 31A in the thermal head 31, the printing device 1 applies thermal energy to portions of the printing sheet 3A (see FIGS. 1 and 2) in contact with the energized heating elements 31A. Through this process, a line configured of a plurality of dots in a row (hereinafter called a "print line") aligned in the width direction of the printing sheet 3A, i.e., the main scanning direction, is formed on the printing sheet 3A.

At the same time, the printing sheet 3A is conveyed by the rotation of the platen roller 26 along the sub scanning direction orthogonal to the main scanning direction. Through this operation, a plurality of print lines juxtaposed in the sub scanning direction is formed on the printing sheet 3A. The left direction in FIG. 4A corresponds to the conveying direction of the printing sheet 3A, i.e., the sub scanning direction. The first print line formed on the printing sheet 3A when the printing operation is started (hereinafter called the "start line Gs") is arranged on the leftmost side of the print image G.

The amount of power consumed in a printing operation for a single print line varies according to the number of ON dots N in the print line. The number of ON dots N is the number of heating elements 31A that generate heat when printing the print line. The amount of power consumed for each print line (hereinafter called the "line power amount Wtotal") can be represented by the following equation (a) when P is the power consumed by energizing a single heating element 31A and Ton is the duration of time for energizing the heating elements in order to form a single print line (hereinafter called the "heating time Ton").

$$\mathrm{Wtotal}=N\times P\times T\mathrm{on} \quad \text{(a)}$$

Here, the line power amount Wtotal is expressed in watts-seconds (W·s) when the power P is expressed in watts (W) and the heating time Ton is expressed in seconds (s). In the first embodiment, the CPU 52 calculates the power (N×P) consumed by the heating elements 31A per unit time on the basis of the print data.

Further, by using the line power amount Wtotal and a prescribed cycle required for forming a print line (hereinafter called a "cycle time Tc"), the average power which is the average value per unit time (time-average value) of the amount of power consumed while printing a single print line during cycle time Tc (hereinafter called a "cycle power Wa") can be represented according to the following equation (b).

$$\mathrm{W}a=\mathrm{Wtotal}/Tc \quad \text{(b)}$$

Figure 4B:
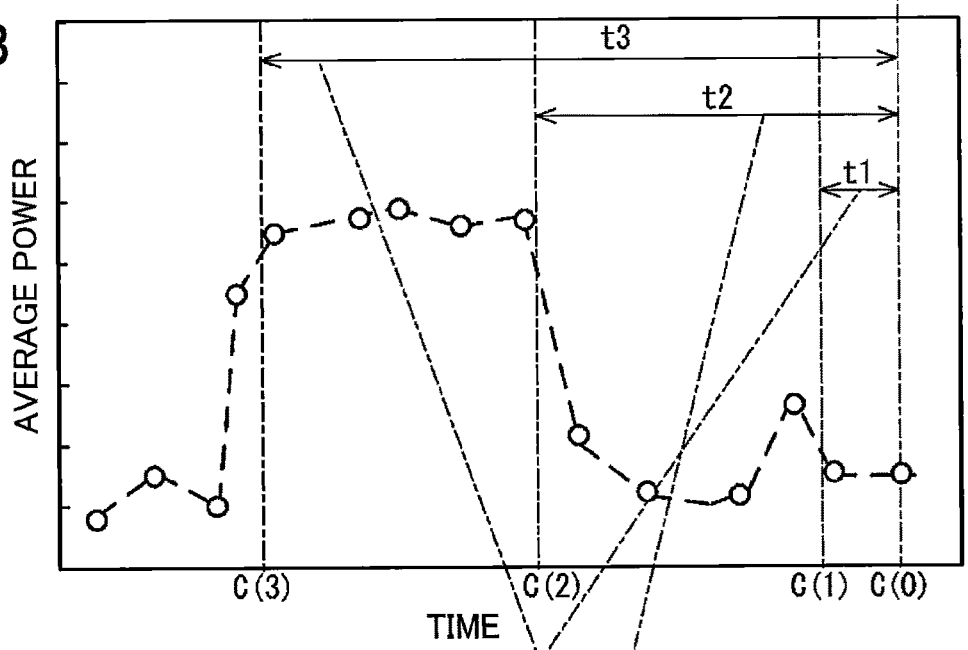
FIG. 4B is a graph showing cycle power for each print line plotted over time when the print image illustrated in FIG. 4A is printed.

Here, the cycle power Wa is expressed in watts (W) when the line power Wtotal is expressed in watts-seconds (W·s) and the cycle time Tc is expressed in seconds (s). FIG. 4B is a graph showing the cycle power Wa for each print line plotted over time when printing the print image G illustrated in FIG. 4A.

Note that the cycle time Tc is the sum of the heating time Ton and an idle time Toff. The idle time Toff is the duration of time that elapses after halting the supply of current to heating elements 31A in the thermal head 31 for printing one print line until beginning to supply current to heating elements 31A for printing the next print line. Specifically, the idle time Toff includes the duration of time during which the printing sheet 3A is conveyed in the sub scanning direction and an extra period of time.

In the present embodiment, the heating time Ton is constant for each of the plurality of print lines. However, the idle time Toff is varied in a first main process described later. Consequently, the cycle time Tc also varies according to the changes in idle time Toff. More specifically, when the idle time Toff is shortened, the cycle time Tc is also shortened. In this case, the cycle power Wa for the shortened cycle time Tc is larger. On the other hand, when the idle time Toff is lengthened, the cycle time Tc is also lengthened. In this case, the cycle power Wa for the lengthened cycle time Tc is reduced. While this will be described later in greater detail, the printing device 1 adjusts the cycle time Tc in order to adjust the cycle power Wa for each print line.

<Parameter Sets S>

The power consumed during a printing operation on the printing device 1 is limited by average power upper limits Wlim corresponding to the following specifications:

(1) the rating of power consumption in the AC adapter 32;
(2) the rating of the fuse 33 in the AC adapter 32; and
(3) the rating of a value based on the thermal rating of the AC adapter 32 or the rated current of the adapter IC 34 in the AC adapter 32.

The average power upper limit Wlim denotes the upper limit of the average power which is the average value per unit time (time-average value) of the amount of power consumed as a result of energizing a plurality of heating elements 31A during a corresponding limiting period of time t.

In the following description, the average power upper limit Wlim corresponding to the ratings listed above under (1), (2), and (3) will be called the average power upper limits Wlim1, Wlim2, and Wlim3, respectively. The limiting periods of time t corresponding to these average power upper limits Wlim1, Wlim2, and Wlim3 will respectively be called the limiting periods of time t1, t2, and t3. The set of parameters that includes at least the average power upper limit Wlim1 and the limiting period of time t1 will be called a parameter set S1, the set of parameters that includes at least the average power upper limit Wlim2 and the limiting period of time t2 will be called a parameter set S2, and the set of parameters that includes at least the average power upper limit Wlim3 and the limiting period of time t3 will be called a parameter set S3. The parameter sets S1, S2, and S3 will be collectively called the parameter sets S.

FIG. 5 illustrates specific values for each of the parameter sets S1, S2, and S3 (the limiting period of time t and average power upper limit Wlim). The average power upper limit Wlim is defined as the upper limit of the average power consumption per unit time during the limiting period of time t (t1, t2, t3). As shown in the table, the average power upper limit Wlim1 (600 W), the average power upper limit Wlim2 (400 W), and the average power upper limit Wlim3 (60 W) for the respective parameter sets S1, S2, and S3 decrease along with increase in the corresponding limiting period of time t1 (10 ms), limiting period of time t2 (100 ms), and limiting period of time t3 (10 s).

Each parameter set S also includes a first set cycle power Wmax, and a second set cycle power Wmin. The first set cycle power Wmax (650 W) is set on the basis of the value for the absolute rated current of a driver IC (not illustrated) provided in the thermal head 31, for example, and corresponds to power consumption that is never exceeded even for an instant (maximum instantaneous power). A single common first set cycle power Wmax is predetermined for all parameter sets S1, S2, and S3 and has the following prescribed relationships with the average power upper limits Wlim, that is, Wmax=Wlim1+Z1 (600+50 W)=Wlim2+Z2 (400+250 W)=Wlim3+Z3 (60+590 W). Hence, the first set cycle power Wmax is larger than all of the average upper limits Wlim.

Note that the first set cycle power Wmax may be set to a value based on any of the specifications described above, including the rated power consumption for the AC adapter 32, the thermal rating of the AC adapter 32, the rating of the fuse 33 provided in the AC adapter 32, and the rating of the adapter IC 34 provided in the AC adapter 32.

The second set cycle power Wmin is set on the basis of a desired printing speed identified to be the speed at which the average power Wave described later does not exceed the corresponding average power upper limit Wlim. One second set cycle power Wmin is set for each of the parameter sets S1, S2, and S3. The second set cycle powers Wmin corresponding to the parameter sets S1, S2, and S3 will be given the notation Wmin1 (550 W), Wmin2 (350 W), and Wmin3 (40 W). The second set cycle power Wmin1 is a value obtained by subtracting a prescribed value Y1 (50 W) from the average power upper limit Wlim1. The second set cycle power Wmin2 is a value obtained by subtracting a prescribed value Y2 (50 W) from the average power upper limit Wlim2. The second set cycle power Wmin3 is a value obtained by subtracting a prescribed value Y3 (20 W) from the average power upper limit Wlim3. Hence, each second set cycle power Wmin is smaller than the corresponding average power upper limit Wlim.

Note that the second set cycle powers Wmin may be set to values based on any of the specifications described above, including the rated power consumption for the AC adapter 32, the thermal rating of the AC adapter 32, the rating of the fuse 33 provided in the AC adapter 32, and the rating of the adapter IC 34 provided in the AC adapter 32.

<Control of Printing Operations>

The printing device 1 adjusts the idle time Toff to values within a range in which the time-average value of the total sum of amounts of power consumed by driving a plurality of heating elements 31A during the limiting period of time t does not exceed the average power upper limit Wlim according to the parameter sets S1, S2, and S3. Hereinafter, the total sum of amounts of power consumed by driving the plurality of heating elements 31A during the limiting period of time t will be called the "total amount of printing power" for the limiting period of time t. Through this process, the printing device 1 shortens the cycle time Tc while operating the AC adapter 32 and the like normally in order to shorten the time required for the printing operation. This control will be described next in greater detail.

Here, the case of setting the cycle time Tc when printing the rightmost print line Gn illustrated in FIG. 4A will be used as an example. In this case, the printing device 1 calculates the total amount of printing power within an interval between a timing C (C(1), C(2), C(3)) and the print timing C(0) for each of the parameter sets S1, S2, and S3. As illustrated n FIG. 4B, the print timing C(0) is the timing at which the printing operation on the print line Gn is started, and the timing C (C(1), C(2), C(3)) is preceding the print timing C(0) by the limiting period of time t (t1, t2, t3).

For example, the total amount of printing power for the parameter set S1 (the limiting period of time t1) is calculated to be the sum of line power amounts Wtotal, i.e., the sum of values obtained by respectively multiplying the cycle powers Wa by the cycle times Tc (the time integral value of the cycle power Wa), consumed during the operations for printing print lines within the interval from C(1) to C(0). The method of calculating the total amount of printing power for the parameter set S2 (the limiting period of time t2) and the total amount of printing power for the parameter set S3 (the limiting period of time t3) is similar. In the following description, the total amount of printing power calculated through this method will be referred to as Q (Q1, Q2, Q3).

Figure 4C:
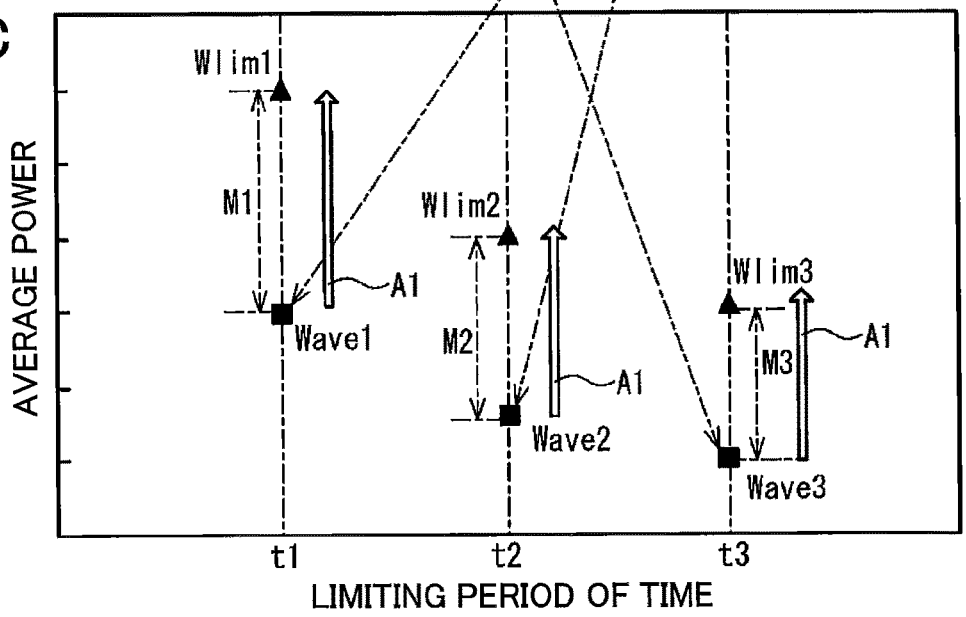
FIG. 4C is a graph showing average powers respectively calculated for limiting periods of time illustrated in FIG. 4B.

Next, the printing device 1 calculates the average of the total amount of printing power Q within the limiting period of time t (hereinafter called the "average power Wave (Wave1, Wave2, Wave3)") by dividing the total amount of printing power Q calculated according to the above method by the corresponding limiting period of time t. For example, the average power Wave1 for the total amount of printing power Q1 is calculated by dividing the total amount of printing power Q1 by the limiting period of time t1 (Q1/t1). The average powers Wave2 and Wave3 are calculated in the same manner. FIG. 4C is a graph showing the average powers Wave1, Wave2, and Wave3 respectively calculated for limiting periods of time t1, t2, and t3.

The printing device 1 sets the idle time Toff for printing operations on print lines beginning from the print line Gn on the basis of the first set cycle power Wmax used commonly for the parameter sets S1, S2, and S3 and the second set cycle power Wmin corresponding to one of the parameter sets S1, S2, and S3. Specifically, the printing device 1 sets the idle time Toff in the cycle time Tc so that the cycle power Wa during printing operations on the print line Gn is no greater than the first set cycle power Wmax when all three of the following conditions are satisfied (see FIG. 4C, for example):

(Condition 1) average power Wave1 is smaller than or equal to average power upper limit Wlim1;

(Condition 2) average power Wave2 is smaller than or equal to average power upper limit Wlim2; and (Condition 3) average power Wave3 is smaller than or equal to average power upper limit Wlim3.

More specifically, the printing device 1 sets the idle time Toff included in the cycle time Tc for printing the print line Gn to a shorter length within a range in which the cycle power Wa during printing operations on the print line Gn is less than or equal to the first set cycle power Wmax. In the present embodiment, the greater the cycle power Wa is, the shorter the idle time Toff is. Therefore, the printing device 1 sets the idle time Toff and cycle time Tc so that the cycle power Wa is equal to the first set cycle power Wmax. Since the cycle time Tc for printing the print line Gn is shortened in this way, the time required to complete printing operations on the print line Gn is shortened. In this case, power greater than the average powers Wave1, Wave2, and Wave3 (equal to the first set cycle power Wmax) is consumed during printing operations on the print line Gn.

Note that the first set cycle power Wmax is a larger value than any of the average power upper limits Wlim1, Wlim2, and Wlim3 (see FIG. 5). However, the AC adapter 32 can operate within the ranges of ratings corresponding to each of the parameter sets S1, S2, and S3, as long as the average power Wave (Wave1, Wave2, Wave3) does not exceed the corresponding average power upper limit Wlim (Wlim1, Wlim2, Wlim3).

Figure 7A:
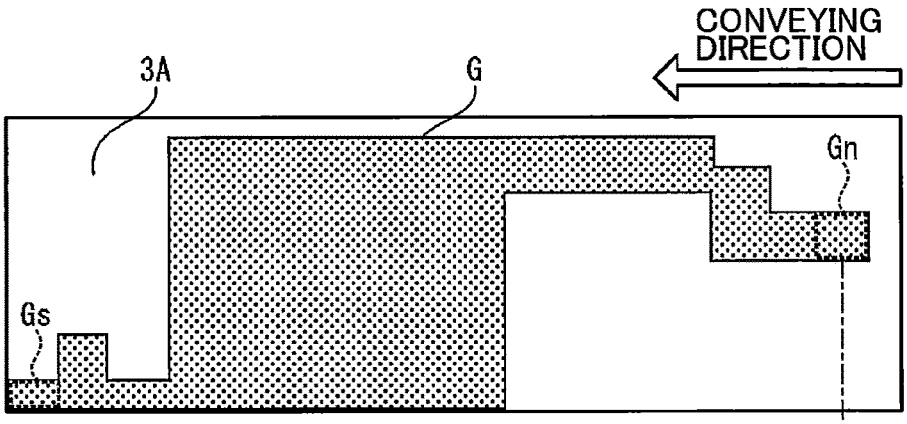
FIG. 7A illustrates the example of the print image formed through printing operations by the printing device according to the first embodiment.
Figure 7B:
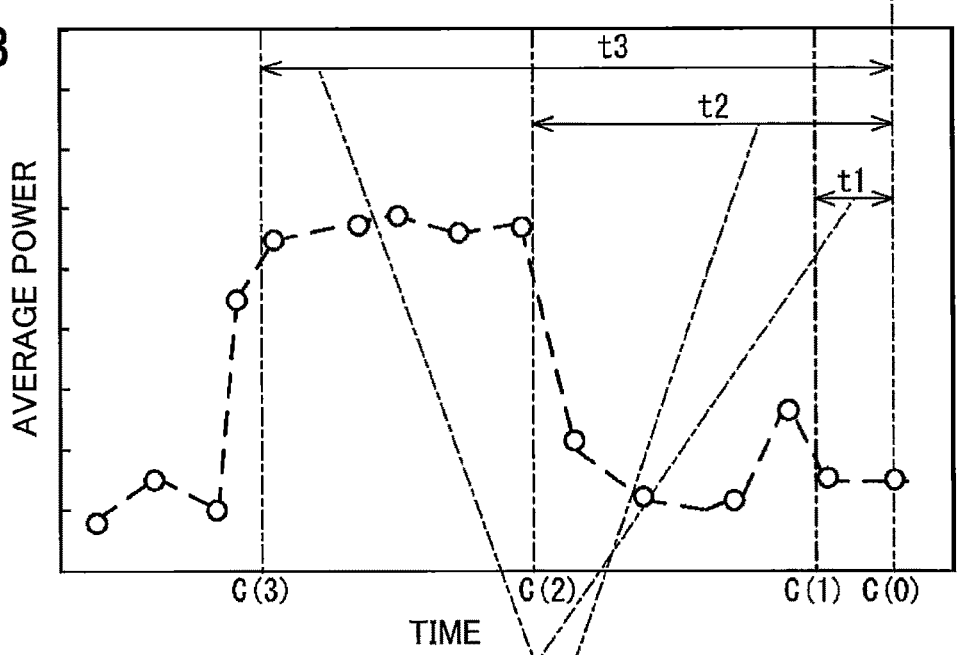
FIG. 7B is a graph showing cycle power for each print line plotted over time when the print image illustrated in FIG. 7A is printed.
Figure 7C:
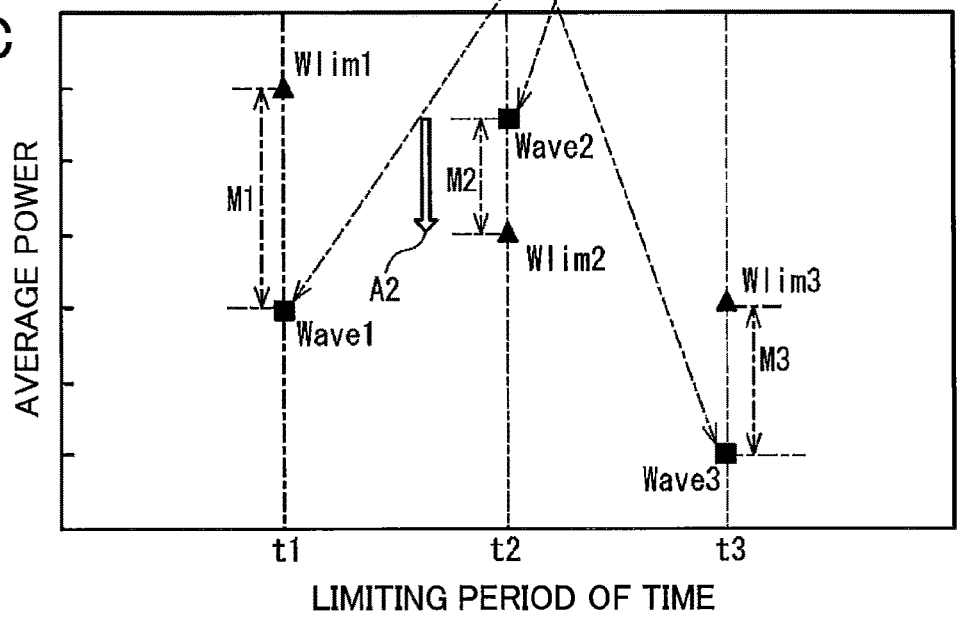
FIG. 7C is a graph showing average powers respectively calculated for limiting periods of time illustrated in FIG. 7B.

On the other hand, if print lines are repeatedly printed so that the cycle power Wa does not exceed the first set cycle power Wmax (in the present embodiment, so that the cycle power Wa is equal to the first set cycle power Wmax), the average powers Wave1, Wave2, and Wave3 may gradually increase to the point of exceeding the corresponding average power upper limits Wlim (Wlim1, Wlim2, and Wlim3). In such a case, the second set cycle power Wmin is selected from the parameter set S corresponding to the smallest difference value M from among a difference value M1 between the average power upper limit Wlim1 and average power Wave1, a difference value M2 between the average power upper limit Wlim2 and average power Wave2, and a difference value M3 between the average power upper limit Wlim3 and average power Wave3 (see FIG. 4C). Note that since the average power Wave2 exceeds the average power upper limit Wlim2 in FIG. 7C described later, the difference value M2 is a negative value and, therefore, the smallest.

For example, among (Condition 1), (Condition 2), and (Condition 3) described above, the average power upper limit Wlim3 is the smallest of the average power upper limits Wlim, and the timing at which the corresponding average power Wave3 exceeds the average power upper limit Wlim3 may arrive soonest (see arrows A1 in FIG. 4C). Say for example, the printing device 1 is repeatedly printing print lines beginning from the print line Gn, and the average power Wave3 exceeds the average power upper limit Wlim3 at the timing for printing a print line Gm (m>n; see FIG. 6), the printing device 1 sets the idle time Toff for the cycle time Tc such that the cycle power Wa for operations to print the print line Gm is no greater than the first set cycle power Wmax but greater than or equal to the second set cycle power Wmin3. More specifically, the printing device 1 sets the idle time Toff included in the cycle time Tc for printing the print line Gm to a longer value than the previous. In the present embodiment, the printing device 1 sets the idle time Toff and cycle time Tc so that the cycle power Wa is equal to the second set cycle power Wmin3. In this case, the second set cycle power Wmin3 is consumed during printing operations on the print line Gm.

Figure 6:
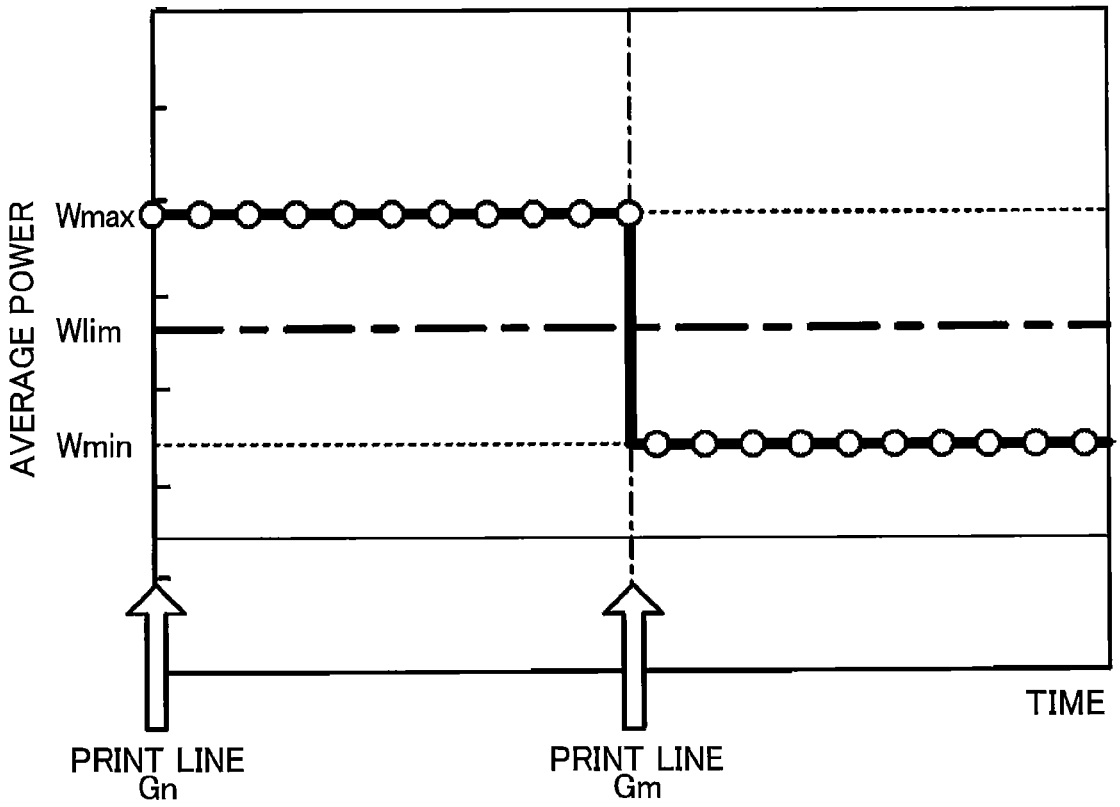
FIG. 6 is a graph showing cycle power for each print line plotted over time when print lines following the print image illustrated in FIG. 4A is printed.

The graph illustrated in FIG. 6 plots the cycle power Wa consumed over time during printing operations for printing each print line beginning from the print line Gn. As illustrated in FIG. 4, the printing device 1 repeatedly prints print lines at the first set cycle power Wmax before switching to the second set cycle power Wmin3, and thereafter prints print lines at the second set cycle power Wmin3. Note that after repeatedly printing with a cycle time Tc set so as not to exceed the first set cycle power Wmax, the printing device 1 switches to the second set cycle power Wmin3 and sets the cycle time Tc so as to be able to print repeatedly without exceeding the second set cycle power Wmin3. At this time, the cycle power Wa gradually decreases over time between the first set cycle power Wmax and second set cycle power Wmin.

Next, a printing operation will be described for a case in which the average power Wave exceeds the average power upper limit Wlim. When (Condition 1) and (Condition 3) among the above-described (Condition 1), (Condition 2), and (Condition 3) are satisfied but (Condition 2) is not, as in the example of FIG. 7C, the average power Wave2 will exceed the average power upper limit Wlim2 when the print line Gn is printed unless the cycle power Wa is reduced to the second set cycle power Wmin2 or lower. In this case, the printing device 1 sets the idle time Toff used in operations for printing the print line Gn on the basis of the second set cycle power Wmin2 of the parameter set S2. More specifically, the printing device 1 sets the idle time Toff included in the cycle time Tc for printing the print line Gn to a longer value in order that the idle time Toff becomes shorter within a range in which the cycle power Wa consumed in operations for printing the print line Gn is equal to or less than the second set cycle power amount Wmin2, that is, in order that the cycle power Wa is equal to the second set cycle power Wmin2. In this case, the second set cycle power Wmin2 is consumed during operations for printing the print line Gn.

Here, the second set cycle power Wmin2 is smaller than the average power upper limit Wlim2 by the value Y2 (50 W; see FIG. 5). Accordingly, the difference value M2 between the average power upper limit Wlim2 and average power Wave gradually decreases while print lines are repeatedly printed with the cycle power Wa set to the second set cycle power Wmin2 and reaches zero or less at the average power upper limit Wlim2 (see arrow A2 in FIG. 7C).

Further, if more than one of the three conditions (Condition 1), (Condition 2), and (Condition 3) are not satisfied, the printing device 1 sets the cycle time Tc by applying the value for the second set cycle power Wmin corresponding to the smallest average power upper limit Wlim among the average power upper limits Wlim respectively corresponding to the conditions not satisfied and continues printing print lines using this cycle time Tc. For example, if all conditions (Condition 1), (Condition 2), and (Condition 3) are not satisfied, the printing device 1 sets the idle time Toff in the cycle time Tc such that the cycle power Wa for printing operations on the print line Gm is equal to the second set cycle power Wmin3 in the parameter set S3 corresponding to (Condition 3), which is the smallest one among three second set cycle power Wmin1, Wmin2, and Wmin3.

<First Main Process>

Figure 8:
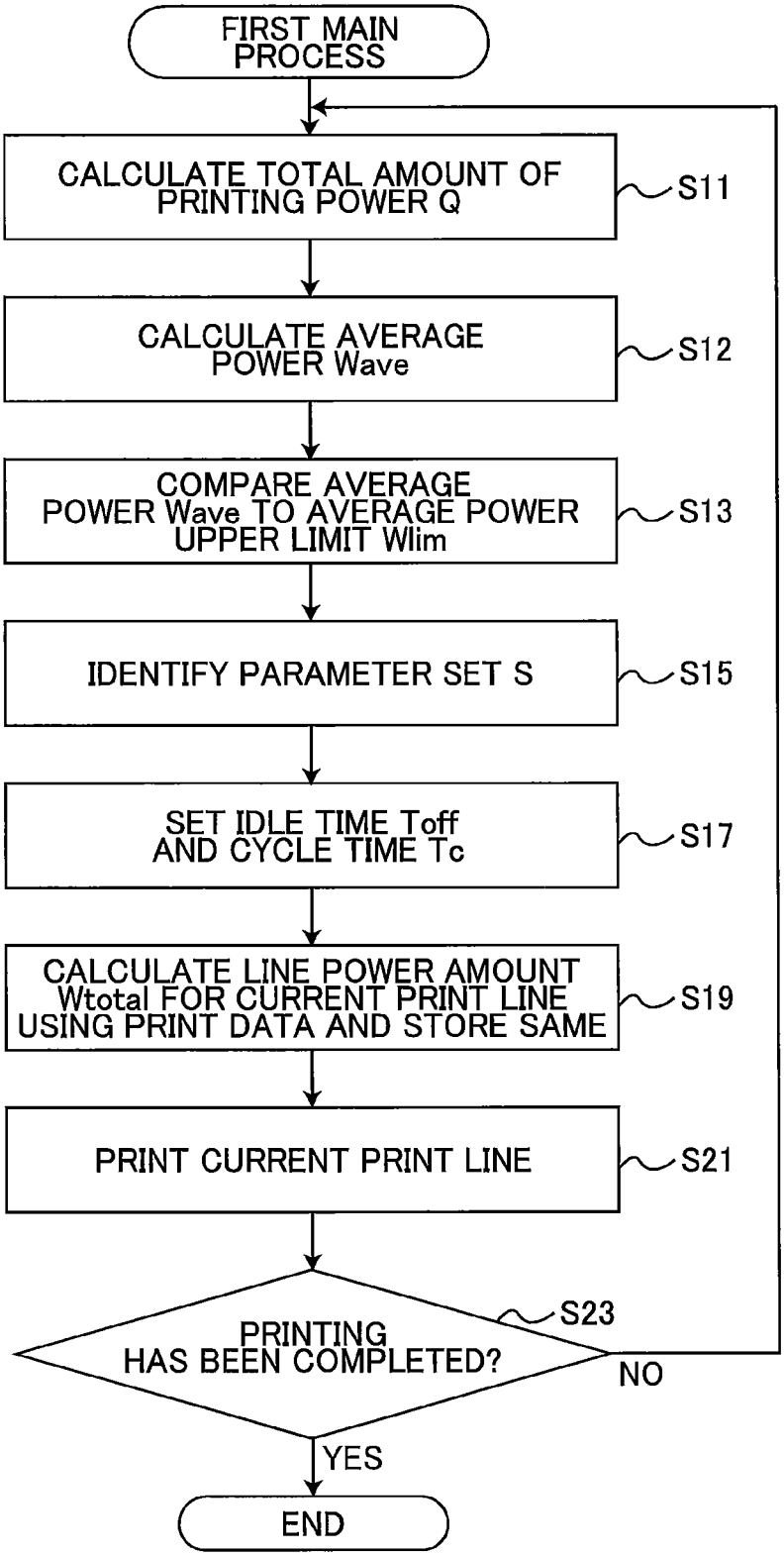
FIG. 8 is a flowchart illustrating steps in a first main process executed by a CPU of the printing device according to the first embodiment.

Next, a first main process performed on the printing device 1 according to the first embodiment will be described with reference to FIG. 8. When the printing device 1 receives print data representing the print image G from an external terminal, the CPU 52 stores the received print data in the flash memory 55 and starts the first main process by reading the program from the ROM 53 and executing the program. The printing device 1 executes the first main process so as to print on a printing sheet 3A the print image G made up of a plurality of print lines one print line at a time.

In S11 of the first main process the CPU 52 calculates the total amount of printing power Q (Q1, Q2, Q3) for each of the parameter sets S (S1, S2, S3) on the basis of the limiting period of time t for each parameter set S. When the process of S11 is first executed at the beginning of the first main process, i.e., immediately before printing the print line Gs (see FIG. 4A), the CPU 52 calculates zero as the total amount of printing power Q (Q1, Q2, Q3) for each parameter set S. When the process of S11 is executed immediately before printing the print line Gn (see FIG. 4A), the CPU 52 calculates the total amount of printing power Q (Q1, Q2, Q3) for the limiting period of time t (t1, t2, t3) before the timing C(0) (see FIG. 4B). The following description will be made for a case where the CPU 52 executes the process in S11 to S19 when printing the print line Gn in S20. The print line Gn will be also called "current print line Gn."

Note that the line power amount Wtotal for each of the plurality of print lines printed prior to the current print line Gn is stored in the flash memory 55 in the process of S19 described later while the first main process is repeatedly executed. The CPU 52 acquires the line power amounts Wtotal corresponding to the print lines that were printed during the limiting period of time t1 (period from C(1) to C(0)) by reading these line power amounts Wtotal from the flash memory 55, and calculates the total amount of printing power Q1 by adding the line power amounts Wtotal together. The total amounts of printing power Q2 and Q3 are calculated in the same manner.

In S12 the CPU 52 calculates the average power Wave (Wave1, Wave2, Wave3) for each of the limiting periods of time t (t1, t2, t3) by dividing each total amount of printing power Q calculated in S11 by the corresponding limiting period of time t. In S13 the CPU 52 compares the average powers Wave (Wave1, Wave2, Wave3) calculated in S12 to the average power upper limits Wlim (Wlim1, Wlim2, Wlim3), respectively. In S15 the CPU 52 identifies the parameter set S that includes the most suitable average power upper limit Wlim based on the results of comparisons between the average powers Wave and average power upper limits Wlim.

In S17 the CPU 52 sets the idle time Toff for printing operations on the current print line Gn on the basis of the first set cycle power Wmax and the second set cycle power Wmin included in the parameter set S identified in S15. Also in S17 the CPU 52 sets the cycle time Tc by adding the heating time Ton to the idle time Toff.

In S19 the CPU 52 identifies the number of ON dots N in the current print line Gn according to the print data stored in the flash memory 55 and calculates the line power amount Wtotal for the current print line Gn by applying equation (a) to the identified number of ON dots N. Also in S19 the CPU 52 stores the calculated line power amount Wtotal in the flash memory 55. Here, the line power amount Wtotal stored in the flash memory 55 for the current print line Gn will be used for calculating the total amount of printing power Q in the process of S11 performed when print lines following the current print line Gn is printed. In other words, the CPU 52 calculates according to the print data the line power amount Wtotal consumed by the plurality of heating elements 31A while a print line is printed and calculates the total amount of printing power Q based on the calculated line power amounts Wtotal. Hence, the CPU 52 calculates the average powers Wave (Wave1, Wave2, Wave3) from the total amounts of printing powers Q (Q1, Q2, Q3).

In S21 the CPU 52 prints the current print line Gn on the basis of the cycle time Tc set in S17. In S23 the CPU 52 determines whether the entire print image G has been printed. When printing is not complete (S23: NO), the CPU 52 returns to S11 and repeats the process in S11 to S21 on each print line following the print line Gn. Hence, the CPU 52 calculates the average powers Wave (Wave1, Wave2, Wave3) based on the total amounts of printing powers Q (Q1, Q2, Q3) in the process of S12 for each cycle by which print control is executed on one print line. When the CPU 52 determines that printing is complete (S23: YES), the CPU 52 ends the first main process.

<Effects of the First Embodiment>

As described above, the printing device 1 sets the cycle time Tc by setting the cycle power Wa consumed during print control for a print line that prevents the average power Wave from exceeding the average power upper limit Wlim. Accordingly, the printing device 1 can increase printing speed to reduce the time required to complete the printing operation by adjusting the cycle time Tc while accounting for the average power upper limits Wlim (Wlim1, Wlim2, Wlim3) in the parameter sets S (S1, S2, S3).

The printing device 1 sets the cycle time Tc so that power no greater than the first set cycle power Wmax, which is greater than all of the average power upper limits Wlim1, Wlim2, and Wlim3, is consumed during print control. Accordingly, the printing device 1 can accelerate the printing speed while performing the print control so that the cycle power Wa does not exceed the first set cycle power Wmax.

The printing device 1 sets the cycle time Tc such that a cycle power Wa between the first set cycle power Wmax and second set cycle power Wmin is consumed during print control. In other words, the printing device 1 can control the cycle power Wa for the cycle time Tc based on power between the first set cycle power Wmax and second set cycle power Wmin.

When executing the first main process, the printing device 1 calculates, using the print data, the power consumed by the heating elements 31A while printing a print line, and calculates the average power Wave using the calculated power. Therefore, the printing device 1 can calculate rather than actually measure the average power Wave consumed by the heating elements 31A when executing print control.

The average power upper limits Wlim may be any of a value based on the rated power consumption of the AC adapter 32 that supplies power to the printing device 1, a value based on the thermal rating of the AC adapter 32, a value based on the rating of the fuse 33 provided in the AC adapter 32, and a value based on the electric current rating of the adapter IC 34 provided in the AC adapter 32. Therefore, by performing print control based on the parameter set S1, the printing device 1 can reduce the potential for malfunctions caused by the ratings of the AC adapter 32. Further, by performing print control based on the parameter set S3, the printing device 1 can reduce the potential for malfunctions caused by heat generated in the AC adapter 32 and malfunctions caused by the adapter IC 34. Further, by performing print control based on the parameter set S2, the printing device 1 can reduce the potential for malfunctions caused by a blown fuse 33.

The first set cycle power Wmax may be a value based on any of the rated power consumption of the AC adapter 32 that supplies power to the printing device 1, the thermal rating of the AC adapter 32, the rating of the fuse 33 provided in the AC adapter 32, and the rating of the adapter IC 34 provided in the AC adapter 32. For this reason, the printing device 1 can accelerate the printing speed while performing printing operations based on the first set cycle power Wmax set according to the circuit configuration. Further, the second set cycle power Wmin is a value based on any one of the rated power consumption of the AC adapter 32 that supplies power to the printing device 1, the thermal rating of the AC adapter 32, the rating of the fuse 33 provided in the AC adapter 32, and the rating of the adapter IC 34 provided in the AC adapter 32. For this reason, the printing device 1 can accelerate printing speed while performing printing operations based on the second set cycle power Wmin set according to the circuit configuration.

The average power upper limits Wlim (Wlim1, Wlim2, and Wlim3) become smaller as the length of the corresponding limiting periods of time t (t1, t2, t3) increase. The printing device 1 calculates the average power Wave for each cycle time Tc by which print control is executed. Accordingly, the printing device 1 can control printing speed precisely, thereby reducing the time required for completing the printing operation.

Second Embodiment

Figure 9:
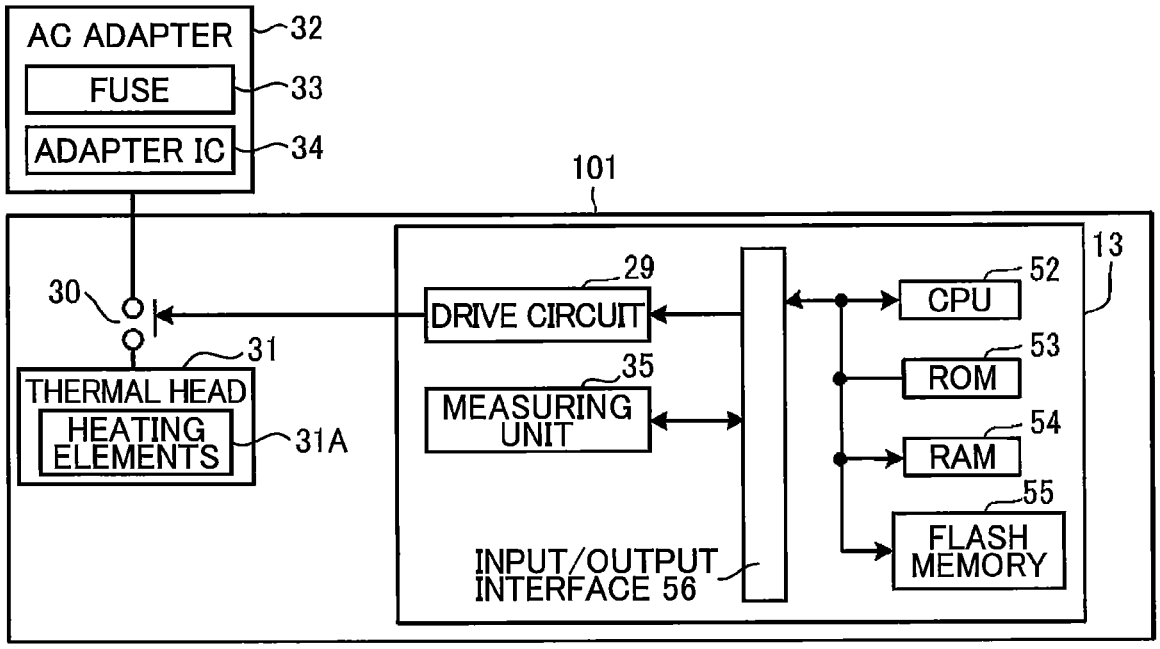
FIG. 9 is a block diagram illustrating an electrical structure of a printing device according to a second embodiment.
Figure 10:
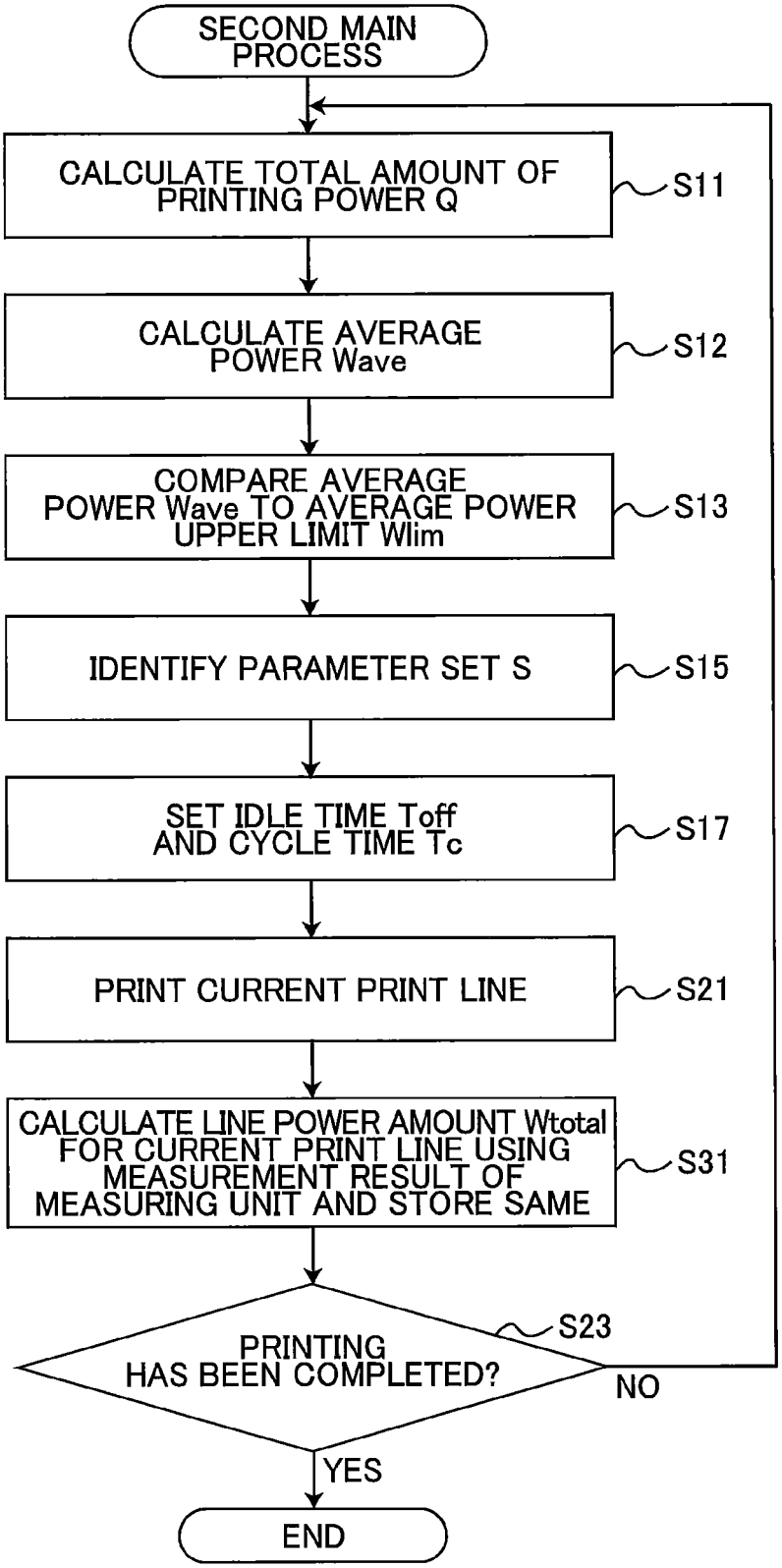
FIG. 10 is a flowchart illustrating steps in a second main process executed by the CPU of the printing device according to the second embodiment.

Next, a printing device 101 according to a second embodiment will be described with reference to FIGS. 9 and 10. The second embodiment differs from the first embodiment in that a measuring unit 35 is provided on the control board 13. The remaining structure of the printing device 101 in the second embodiment is identical to the printing device 1 in the first embodiment, and like parts and components are designated with the same reference numerals to avoid duplicating description.

The measuring unit 35 is disposed on the control board 13, and is electrically connected to the CPU 52 via the input/output interface 56. The measuring unit 35 has a voltage-dividing circuit (not illustrated) for detecting partial voltage, for example. The measuring unit 35 measures a voltage drop across the heating elements 31A through which electric current is flowing, and transmits an analog-to-digital conversion value of the measured value of the voltage drop to the CPU 52. The CPU 52 calculates the power (N×P) consumed by the heating elements 31A using the measured value of the voltage drop indicated by the analog-to-digital conversion value received from the measuring unit 35. The CPU 52 controls the drive circuit 29 on the basis of this calculated power.

The measuring unit 35 may also have an application-specific integrated circuit (ASIC) for calculating the power (N×P) consumed by the heating elements 31A.

<Second Main Process>

Next, a second main process will be described with reference to FIG. 10. The second main process differs from the first main process in that step S19 is not executed, but step S31 is executed after step S21 instead.

When executing a printing operation in S21 of the second main process on the current print line Gn according to the cycle time Tc set in S17, the sensor 35 (see FIG. 9) measures the electric current flowing through the heating elements 31A and transmits a signal indicating the measured electric current. The CPU 52 acquires the power (N×P) based on the electric current indicated by the signal received from the measuring unit 35. In S31 the CPU 52 calculates the line power amount Wtotal for the current print line Gn by multiplying the heating time Ton by the power acquired from the measured results by the measuring unit 35. In S31 the CPU 52 also stores the calculated line power amount Wtotal in the flash memory 55. The remainder of the process is identical to the first main process and will not be described here.

<Effects of the Second Embodiment>

When executing the second main process, the printing device 101 acquires the power (N×P) consumed by the heating elements 31A while printing each print line using the measured results by the measuring unit 35, and calculates the average power Wave based on the acquired power (N×P). By calculating the average power Wave based on the measured results, the printing device 101 can control the power with greater precision.

<Variations of the Embodiment>

The embodiments described above can be modified in many ways. Each of the printing device 1 and the printing device 101 (hereinafter called a "printing device 1/101") may calculate the average power Wave by estimating the power consumed by heating elements 31A using a recurrence relation. In this case, the consumed average power Wave may be calculated for a plurality of lines preceding the current print line. Thus, the printing device 1/101 can reduce the processing load required for calculating the average power Wave. Further, since the average power Wave can be calculated without storing the line power amount Wtotal for each print line in the flash memory 55, the required storage capacity of the flash memory 55 can be reduced.

Further, while the printing device 1 compares the average power upper limit Wlim to the average power Wave in S13 of the first main process, the printing device 1 may instead compare an average power threshold X to the average power Wave. Here, the average power threshold X may be included in each of the parameter sets S1, S2, and S3 and stored in the flash memory 55. Average power thresholds X corresponding to the parameter sets S1, S2, and S3 will be called average power thresholds X1, X2, and X3, respectively. The average power thresholds X1, X2, and X3 are set according to the ratings indicated above in the specifications (1) to (3). The average power threshold X can be represented by the following equation (c) using the first set cycle power Wmax and the second set cycle power Wmin, for example.

$$X = \mathrm{Wlim} \times (\mathrm{Wlim} - \mathrm{Wmin}) / (\mathrm{Wmax} - \mathrm{Wmin}) \quad (c)$$

Here, the average power threshold X is expressed in watts (W) when the average power upper limit Wlim, first set cycle power Wmax, and second set cycle power Wmin are expressed in watts (W).

The printing device 1/101 calculates the time-average value of the total amount of printing power Q within the period of time from the timing preceding the print timing for printing the print line Gn by the limiting period of time t to the print timing for printing the print line Gn for each of the parameter sets S1, S2, and S3. However, the printing device 1/101 may calculate the time-average value of the total amount of printing power Q for each of the parameter sets S1, S2, and S3 during any limiting period of time t that includes the print timing. For example, this period of time may be the period of time between the print timing and the timing after the print timing by the limiting period of time t. In this case, the average power Wave for each print line printed during this period of time t may serve as the first set cycle power Wmax, for example. If it is determined that the average power Wave has grown greater than the average power upper limit Wlim while print lines are repeatedly printed, the printing device 1/101 may make the determination to print at the second set cycle power Wmin, for example. Note that the average power Wave consumed for print lines may be a different value from that predicted to be the first set cycle power Wmax.

While the heating time Ton is constant in the embodiments described above, the heating time Ton need not be constant. The heating time Ton may be set differently for each printing speed and printing condition. When varying the heating time Ton, it may be desirable to change the set density to one of five set densities 1 to 5 illustrated in FIG. 11 in association with the printing speeds (20, 40, 50, 60, and 80 mm/sec). By increasing the length of the heating time Ton as the printing speed is slowed, the printing device 1 can print at a higher print density. In this case, the idle time Toff may be set to a value obtained by multiplying the heating time Ton by a multiplier n. In other words, the idle time Toff can be found by the equation Toff=Ton×n. With this configuration, the printing device 1/101 can calculate the cycle time Tc using a simple formula.

In S15 in the first and second main processes performed on the printing device 1/101 of the embodiments, the printing device 1/101 identifies the parameter set S that corresponds to the smallest difference value M among the difference values M1, M2, and M3 between the average power upper limits Wlim and average powers Wave. However, the printing device 1/101 may also store cycle power limits Wx (Wx1, Wx2, Wx3) in the parameter sets S (S1, S2, S3) in association with the difference values M (M1, M2, M3), as illustrated in FIG. 12, select the value for a cycle power limit Wx based on each of the difference values M, and control the cycle power Wa to not exceed the smallest cycle power limit Wx among the selected cycle power limits Wx. In this case, the cycle power limit Wx is set to a value between the first set cycle power Wmax and second set cycle power Wmin.

Alternatively, the cycle power limits Wx may be calculated to correspond with the values of average powers Wave, as illustrated in FIG. 13.

The print control described in the embodiments described above may employ a printing device driven according to another printing method, and is not limited to a thermal printer. Further, while the print control is performed according to ratings of the AC adapter 32 and fuse 33, the ratings of other power modules may be used. The CPU 52 executes the processes in the present embodiment, but the present disclosure is not limited to this configuration. For example, a field-programmable gate array (FPGA), an application-specific integrated circuit (ASIC), or another arithmetic device may be used in place of the CPU 52.

In the embodiments described above, the printing device 1/101 may set the idle time Toff included in the cycle time Tc so that the cycle power Wa is any value less than or equal to the first set cycle power Wmax and greater than or equal to the second set cycle power Wmin when all conditions (Condition 1), (Condition 2), and (Condition 3) are satisfied, for example. This process may also be executed when the cycle power Wa is greater than or equal to the second set cycle power Wmin. Therefore, when the cycle power Wa is smaller than the second set cycle power Wmin, the printing device 1 need not set the idle time Toff so that the cycle power Wa is any value less than or equal to the first set cycle power Wmax and greater than or equal to the second set cycle power Wmin.

In the embodiments described above, one second set cycle power Wmin (Wmin1, Wmin2, Wmin3) is set for each of the parameter sets S (S1, S2, S3) and stored in the flash memory 55. However, a single second set cycle power Wmin may be stored in the flash memory 55 for all parameter sets S1, S2, and S3. For example, the second set cycle power Wmin3, which is the smallest of the second set cycle powers Wmin1, Wmin2, and Wmin3 in the embodiment described above, may be stored as the single second set cycle power Wmin. In other words, the smallest second set cycle power Wmin3 may be used as the second set cycle powers Wmin1 and Wmin2 in the embodiments described above.

The thermal head 31 is an example of the thermal head of the present disclosure. The plurality of heating elements 31A is an example of the plurality of heating elements of the present disclosure. The current print line Gn is an example of the line image subject to calculation of the present disclosure. The flash memory 55 is an example of the memory of the present disclosure. The CPU 52 is an example of the controller of the present disclosure. The AC adapter 32 is an example of the power supply portion of the present disclosure. The fuse 33 is an example of the fuse of the present disclosure. The adapter IC 34 is an example of the IC of the present disclosure.

What is claimed is:

1. A printing device comprising:

a thermal head configured to print an image on a printing medium, the thermal head having a plurality of heating elements aligned in a main scanning direction and configured to be selectively energized to generate heat in accordance with print data, the image being made up of a plurality of line images arranged in a sub scanning direction orthogonal to the main scanning direction, printing of each of the plurality of line images being accomplished during a cycle time including an energizing period of time during which selected heating elements for printing one of the plurality of line images are energized, a feeding period of time during which the printing medium is fed in the sub scanning direction after energization of the selected heating elements, and an extra period of time;

a memory configured to store a plurality of sets of parameters, each set of parameters including one of a plurality of first parameters and corresponding one of a plurality of second parameters, the plurality of first parameters specifying periods of time, the plurality of second parameters specifying upper limits of an average power during the period of time set in corresponding one of the plurality of first parameters; and a controller configured to perform:

calculating an average consumed power with respect to a line image subject to calculation, the average consumed power being calculated by dividing a total amount of consumed power by the period of time set in each of the plurality first parameters, thereby providing a plurality of average consumed powers for respective ones of the plurality of sets of parameters, the total amount of consumed power being an accumulated consumed power consumed in the heating elements energized during printing of a predetermined number of line images in the period of time including a print timing of the line image subject to calculation, printing of the line image subject to calculation starting at the print timing;

setting the cycle time for printing the line image subject to calculation, the cycle time being set so that each of the plurality of average consumed powers does not exceed the upper limit of the average power specified by corresponding one of the plurality of second parameters; and printing the line image subject to calculation in accordance with the cycle time.

2. The printing device according to claim 1, wherein the memory is configured to further store a first cycle power greater than the upper limit of the average power specified by any one of the plurality of second parameters, and wherein the setting sets the cycle time so that a cycle power is less than or equal to the first cycle power, the cycle power being a time-average value of the total amount of power consumed for printing the line image subject to calculation during the cycle time.

3. The printing device according to claim 2, wherein the memory is configured to further store a second cycle power less than the upper limit of the average power specified by any one of the plurality of second parameters, and wherein the setting sets the cycle time so that the cycle power is less than or equal to the first cycle power and greater than or equal to the second cycle power.

4. The printing device according to claim 2, wherein the plurality of heating elements is energized by virtue of a power supply portion provided with a fuse and an IC, and wherein the first cycle power is a value based on any of rated power consumption of the power supply portion, thermal rating of the power supply portion, rating of the fuse, and electric current rating of the IC.

5. The printing device according to claim 3, wherein the controller is configured to further perform determining whether a specific condition is met for the line image subject to calculation, the specific condition requiring that each of the plurality of average consumed powers be less than or equal to the upper limit of the average power specified by corresponding one of the plurality of second parameters, and wherein in response to determining that the specific condition is met, the setting sets the cycle time so that the cycle power is equal to the first cycle power, whereas in response to determining that the specific condition is not met, the setting sets the cycle time so that the cycle power is equal to the second cycle power.

6. The printing device according to claim 3, wherein the plurality of heating elements is energized by virtue of a power supply portion provided with a fuse and an IC, and wherein the second cycle power is a value based on any of rated power consumption of the power supply portion, thermal rating of the power supply portion, rating of the fuse, and electric current rating of the IC.

7. The printing device according to claim 1, wherein the memory is configured to further store the print data, and wherein the calculating uses the print data to calculate a plurality of amounts of power consumed by energizing the plurality of heating elements during printing of the plurality of line images, and calculates the plurality of average consumed power based on the plurality of calculated amounts of power.

8. The printing device according to claim 1, further comprising a sensor configured to measure power consumed by the plurality of heating elements for printing each of the plurality of line images, wherein the calculating acquires from the sensor a plurality of sets of the measured power for each of the plurality of line images, and calculates the plurality of sets of average consumed power based on the plurality of sets of the measured power.

9. The printing device according to claim 1, wherein the plurality of heating elements is energized by virtue of a power supply portion provided with a fuse and an IC, and wherein the upper limit of the average power is a value based on any of rated power consumption of the power supply portion, thermal rating of the power supply portion, rating of the fuse, and electric current rating of the IC.

10. The printing device according to claim 1, wherein the plurality of sets of parameters includes one set of parameters including one of the first parameters and one of the second parameters, and another set of parameters includes another one of the first parameters and another one of the second parameters, the one of the first parameters specifying one specific period of time, the another one of the first parameters specifying another specific period of time longer than the one specific period of time, the one of the second parameters specifying one upper limit of the average power, the another one of the second parameters specifying another upper limit of the average power smaller than the one upper limit of the average power.

11. The printing device according to claim 1, wherein the calculating calculates an amount of power consumed by energizing the plurality of heating elements during printing each of the plurality of line images every time the each of the plurality of line images is printed.

12. A non-transitory computer readable storage medium storing a set of program instructions for a printing device, the printing device including: a thermal head configured to print an image on a printing medium, the thermal head having a plurality of heating elements aligned in a main scanning direction and configured to be selectively energized to generate heat in accordance with print data, the image being made up of a plurality of line images arranged in a sub scanning direction orthogonal to the main scanning direction, printing of each of the plurality of line images being accomplished during a cycle time including an energizing period of time during which selected heating elements for printing one of the plurality of line images are energized, a feeding period of time during which the printing medium is fed in the sub scanning direction after energization of the selected heating elements, and an extra period of time; a memory configured to store a plurality of sets of parameters, each set of parameters including one of a plurality of first parameters and corresponding one of a plurality of second parameters, the plurality of first parameters specifying periods of time, the plurality of second parameters specifying upper limits of an average power during the period of time set in corresponding one of the plurality of first parameters; and a controller, the set of program instructions, when installed on and executed by the controller, causing the printing device to perform:

calculating an average consumed power with respect to a line image subject to calculation, the average consumed power being calculated by dividing a total amount of consumed power by the period of time set in each of the plurality first parameters, thereby providing a plurality of average consumed powers for respective ones of the plurality of sets of parameters, the total amount of consumed power being an accumulated consumed power consumed in the heating elements energized during printing of a predetermined number of line images in the period of time including a print timing of the line image subject to calculation, printing of the line image subject to calculation starting at the print timing;

setting the cycle time for printing the line image subject to calculation, the cycle time being set so that each of the plurality of average consumed powers does not exceed the upper limit of the average power specified by corresponding one of the plurality of second parameters; and printing the line image subject to calculation in accordance with the cycle time.

13. A printing device comprising:

a thermal head configured to print an image on a printing medium, the thermal head having a plurality of heating elements aligned in a main scanning direction and configured to be selectively energized to generate heat in accordance with print data, the image being mead up of a plurality of line images arranged in a sub scanning direction orthogonal to the main scanning direction, printing of each of the plurality of line images being accomplished during a cycle time including an energizing period of time during which selected heating elements for printing one of the plurality of line images are energized, a feeding period of time during which the printing medium is fed in the sub scanning direction after energization of the selected heating elements, and an extra period of time;

a memory configured to store a plurality of sets of parameters, each set of parameters including one of a plurality of first parameters and corresponding one of a plurality of second parameters, the plurality of first parameters specifying periods of time, the plurality of second parameters specifying upper limits of power during the period of time set in corresponding one of the plurality of first parameters; and a controller configured to perform:

determining a consumed power with respect to a line image subject to determination, thereby providing a plurality of consumed powers for respective ones of the plurality of sets of parameters, the total amount of consumed power being an accumulated consumed power consumed in the heating elements energized during printing of a predetermined number of line images in the period of time including a print timing of the ling image subject to determination, printing of the line image subject to determination starting at the print timing;

setting the cycle time for printing the line image subject to determination, the cycle time being set so that each of the plurality of consumed powers does not exceed the upper limit of the power specified by corresponding one of the plurality of second parameters; and printing the line image subject to determination in accordance with the cycle time.

* * * * *